US005748146A

United States Patent [19]

Grove et al.

[11] Patent Number: 5,748,146

[45] Date of Patent: May 5, 1998

[54] PARALLAX INDUCED POLARIZATION LOSS TO REDUCE SIDELOBE LEVELS

[75] Inventors: Carl E. Grove, Sauquoit, N.Y.; Lisa K. Thielking Slaski, Orlando, Fla.

[73] Assignee: United States of America as represented by the Secretary of the Air Force, Washington, D.C.

[21] Appl. No.: 699,768

[22] Filed: Aug. 20, 1996

[51] Int. Cl.[6] ..... H01Q 3/24; H01Q 3/22

[52] U.S. Cl. ..... 342/372; 342/174; 342/165; 343/723; 343/880

[58] Field of Search ..... 343/723, 880, 343/909; 342/173, 174, 165, 360, 361, 372

[56] References Cited

U.S. PATENT DOCUMENTS

| | | | |
|---|---|---|---|
| 4,329,689 | 5/1982 | Yee | 343/700 |
| 4,381,509 | 4/1983 | Rottman et al. | 343/754 |
| 4,575,724 | 3/1986 | Weiner | 343/383 |
| 4,700,196 | 10/1987 | Campbell et al. | 343/797 |
| 4,721,966 | 1/1988 | McGrath | 343/754 |
| 4,740,790 | 4/1988 | Hess et al. | 342/361 |
| 4,786,911 | 11/1988 | Svy | 343/785 |
| 5,075,697 | 12/1991 | Koizumi et al. | 342/361 |

*Primary Examiner*—Thomas H. Tarcza
*Assistant Examiner*—Dao L. Phan
*Attorney, Agent, or Firm*—William G. Auton

[57] ABSTRACT

A sidelobe reduction benefit in a two-way pattern is accomplished when each pattern (transmit or receive) has the same character as traditionally designed, but they differ in polarization. When polarization mismatch is included in the antenna pattern characteristic, the opposite sense of polarization in the sidelobe results in cancellation of signals between transmit and receive and, therefore, a net polarization loss or sidelobe level reduction in the combined two-way pattern. Polarization mismatch is accomplished by designing a separation distance between the transmitting elements and the corresponding receiving elements of the array. Choice of separation distance results in locating the region of perfect polarization mismatch in any desired angular direction.

4 Claims, 3 Drawing Sheets

2-WAY ANTENNA PATTERN

PARALLAX INDUCED POLARIZATION LOSS TO REDUCE SIDELOBE LEVELS

STATEMENT OF GOVERNMENT INTEREST

The invention described herein may be manufactured and used by or for the Government for governmental purposes without the payment of any royalty thereon.

BACKGROUND OF THE INVENTION

This invention relates generally to phased array antennas, and more specifically the invention pertains to a process for reducing sidelobe levels in the far field radar patterns emitted by phased array antenna systems.

THE PRIOR ART

The traditional array design for radar is that the antenna has the same polarization on transmit as receive. The control of sidelobes is historically accomplished through a multitude of schemes of amplitude and/or phase control of the elements in the array. These techniques can yield an array design whose sidelobe levels are limited to the random level generated by the errors present in an, actual array.

Examples of phased array feed systems that are both commonly used as collimating elements in high-gain, narrow beam microwave antennas as described in the following U.S. Patents, the disclosure of which are incorporated herein by reference:

U.S. Pat. No. 4,721,966 issued to Daniel McGrath;

U.S. Pat. No. 4,575,724 issued to Alan Wiener;

U.S. Pat. No. 4,381,509 issued to Walter Rotman;

U.S. Pat. No. 4,131,892 issued to Robert Munson et al;

U.S. Pat. No. 4,263,598 issued to Ernest Bella et al; and

U.S. Pat. No. 4,329,689 issued to Jones Yee.

The microwave lens system of the above-cited references may be used in a number of different applications including communications and direction finding. The choice between a reflector or lens for a given application depends upon many factors. For example, the Rotman lens is considered the optimum beamformer for producing time-delay steered beams over wide angles, but its requirement of a curved back face prohibits application to some problems, most notably those requiring large planar arrays.

Alternatives to the Rotman lens include curved wide-angle lenses and planar lenses. These lens systems are known in the art, and each possess advantages and disadvantages. For example, a planar lens (with a planar front surface which is parallel to a planar back surface) is incapable of wide-angle scanning, because the elements of the back face are normally placed directly behind the front face elements. Curved wide-angle lenses are heavy and expensive to build.

The basic microstrip constrained lens was described in U.S. Pat. No. 4,721,966, "Planar Three-Dimensional Constrained Lens for Wide-Angle Scanning." That patent described the design of a wide-angle microwave lens. It was an improvement over previous microwave lenses, such as the Rotman lens, which were limited to scanning in one plane only.

SUMMARY OF THE INVENTION

The present invention includes a process of reducing sidelobe levels in the antenna pattern of a phased array antenna composed of pairs of transmitting and receiving antenna elements by physically separating the transmitting and receiving antenna elements from each other to induce a parallax induced polarization loss in the elements that principally contribute to sidelobes. The word "parallax" is a noun referring to the optical effect that makes an object appear displaced when viewed from different angles. A meter's pointer can appear at different locations on a dial when viewed from different angles. Similarly, a physical displacement of a receiving antenna element from the location of a transmitting antenna element can adjust the phase and polarization of the received signals.

Changing the polarization in total for the array affects the mainbeam and sidelobe equally and is, therefore, not desirable from a radar viewpoint since mainbeam detectability will be adversely affected and the radar will not function efficiently. The object of the invention is to create an antenna which has opposite or near opposite polarization on receive compared to transmit in the sidelobe region while maintaining the same polarization in the main beam. By doing so, a radar signal which returns from a target is received with the same polarization in the desired main beam direction while the return signals from the sidelobe directions are received preferentially for a cross polarized signal. Consequently, a lower effective sensitivity to sidelobe returns is achieved through polarization mismatch loss in the sidelobe region only. In this invention, polarization mismatch between transmit and receive is induced by having a pair of orthogonally polarized elements which are NOT co-located and a second pair oriented physically orthogonally and similarly offset to the first pair. One pair is used on transmit, the other on receive. The offset or non-colocation creates a parallax induced phase shift between the orthogonal elements in the pair which varies with aspect angle or with varying angle into the sidelobe region. The net phase shift has a 180° differential between the transmit pair and the receive pair due to the orthogonality of the pairs to each other. The result is a polarization change throughout the sidelobe region that is of oppositely varying sense between transmit and receive.

The present invention includes an empirical process that can be used in designing an antenna array to reduce the sidelobe levels. The first step of the process entails identifying the array antenna elements that principally contribute to the generation of sidelobes. For example, in a square array of planar elements, it may be discovered that the edge elements are the primary contributors to sidelobes while the center elements contribute primarily to the main beam. In this instance, the receiving antenna elements of the edges of the array should be displaced by a distance from the corresponding transmitting element to intentionally introduce a polarization mismatch in the signals they receive. This has the effect of nulling out the sidelobe signals from the perceived antenna pattern.

Once the identified elements have been physically separated, they should be tested, and the displacement and testing steps repeated until optimum antenna performance is achieved.

Other sidelobe cancelling schemes make use of phase and amplitude adjustment to signals fed into radiating antenna elements. These adjustment features can also be used along with the adjusting of the physical displacement of distances between transmitting and receiving antenna elements. Polarization mismatch can be induced by having a pair of orthogonally polarized elements which are not co-located. Using orthogonal elements creates two basic vectors for which any polarization can be created by varying the phase between the two elements. Thus, a slant right element and a slant left element can be excited in phase for vertical polarization, 90 out of phase for circular polarization, etc. If the element phase centers are not co-located, the desired polarization will be created only in the main beam direction. Away from the main beam, the offset will create a parallax induced phase shift and a different polarization will exist. Since the parallax phase changes with aspect angle, a different polarization will exist at every point in the sidelobe region.

It is an object of the present invention to reduce the sidelobe levels of antenna patterns by creating a polarization mismatch in sidelobe signals.

It is another object of the present invention to reduce ground clutter effects in radar systems.

It is further an objective to reduce the sensitivity of a radar to intentional or unintentional jamming from a co-polarized signal of other origin. That is, as an Electronic Center Counter-Counter Measure (ECCM) feature.

These objects together with other objects, features and advantages of the invention will become more readily apparent from the following detailed description when taken in conjunction with the accompanying drawings wherein like elements are given like reference numerals throughout.

DESCRIPTION OF THE DRAWINGS

The invention will become more apparent from the following detailed specification and drawings in which.

DETAILED DESCRIPTION OF THE PREFERRED EMBODIMENT

The present invention includes a process for reducing sidelobe levels and the far field patterns of phased array antennas by intentionally inducing a parallax induced polarization loss to the signals of antenna elements at the edges of a planar array. Conventional phased array antenna systems are electronically steered by adjusting the phase of the electronic signals fed to the radiating elements. The operation of these prior art systems is discussed below in order to illustrate how the parallax induced polarization loss techniques of the present invention can be used to reduce the sidelobes in these prior art systems.

The above-cited reference of Rotman provides a description of the Rotman lens principle. That is, an increase in the transmission line length between an outer lens contour point, and an inner lens contour point produces a corresponding increase in phase in an electrical signal as it travels between the outer and inner points. For example, if the transmission line increases by one-half a wavelength, the phase of the signal will increase by 180 degrees. Rotman correlates the changes with the transmission line lengths W directly with the resultant focal arc in wide-angle lens applications. The principles of the Rotman lens are used in the present invention, with the following modifications discussed below.

The Rotman lens, of the above-cited Rotman reference, is a curved lens which relies upon the contour of the curve to provide the changes in length of the transmission lines between the front and back side of the lens. The present invention produces the changes in transmission line lengths by the changes in the radial distribution of the feed antenna elements. The wide angle performance of the resultant focal arc are a natural concomitant, consequent, and result of the carefully selected adjustments of transmission lines length, as discussed in the Rotman reference.

Figure 1:
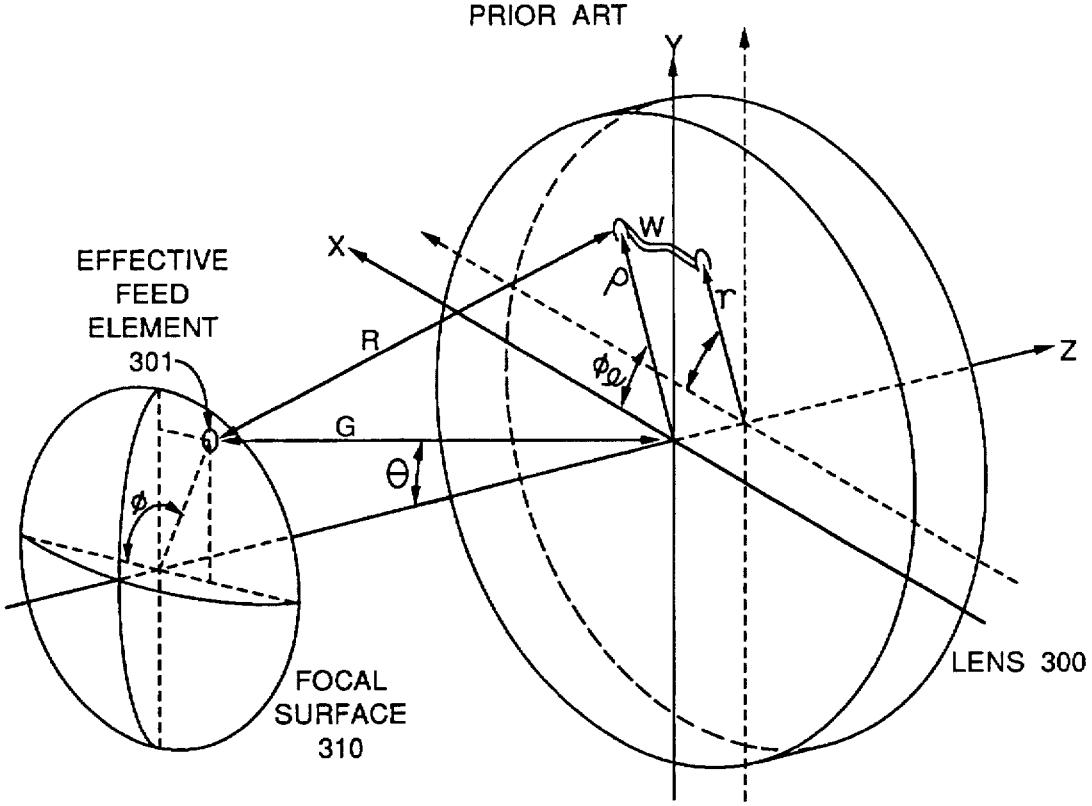
FIG. 1 PRIOR ART
FIG. 1 is an illustration of a prior art beamforming lens system with linear lens geometry.
Figure 2:
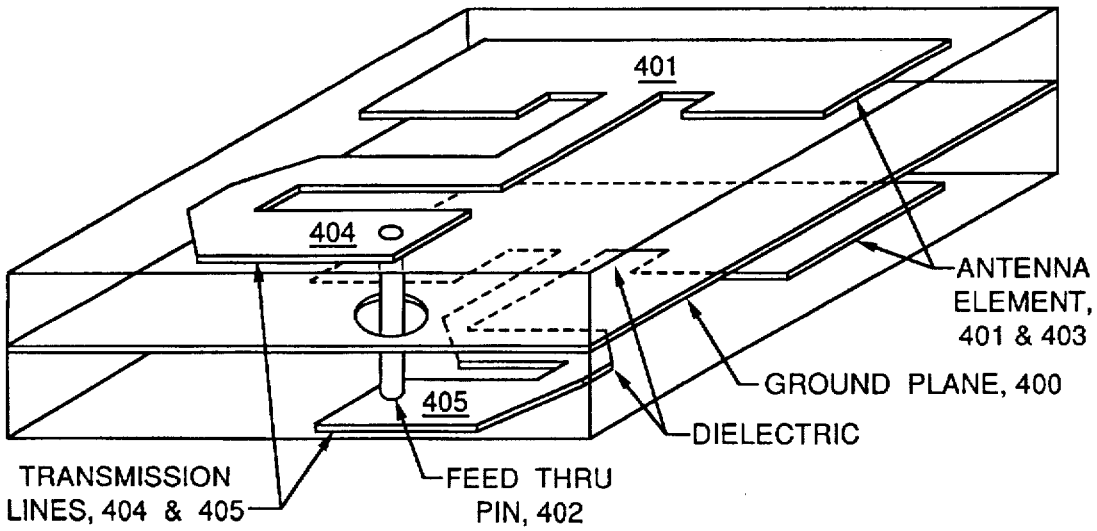
FIG. 2 PRIOR ART
FIG. 2 is a perspective view of a section of microstrip of the lens of a prior art lens system.

The reader's attention is now directed towards FIGS. 1 and 2 which are illustrations of the prior art McGrath antenna system. The beamforming lens system of FIG. 1 includes a planar lens 300, which contains antenna elements which have distributions and variations of transmission line lengths that simulate a distribution of effective feed elements 301 distributed over a concave focal surface 310.

The lengths of transmission line joining elements of opposing faces varies as a function of radius, and the back face elements are displaced radially (they are not directly behind their corresponding front face elements). The amount of that displacement is also a function of radius. Complete details are given in the discussion presented in the above-cited McGrath patent.

FIG. 2 is a perspective view of a section of microstrip constrained lens which is fabricated to form the specific embodiment of the invention depicted in FIG. 1. It is made up of two printed circuit arrays with elements facing in opposite directions above a common ground plane 400. Each feed side element has a transmission line 401 which is connected by a feed-through 402 to the aperture side element 403.

When the lens of FIG. 2 functions as a receiving antenna, the aperture side element; collects radio frequency energy and routes it along the top transmission lie 404 and down the feed-through hole to the bottom transmission line 405. The feed side element 401 then re-radiates that energy toward the feed. For a transmitting antenna, that sequence is reversed.

The aperture side array is photoetched on a double-sided copper-clad printed circuit board. Small holes for the feed-throughs are etched on the other side. The feed side array, etched on single-clad board, is placed back-to-back with the first board, as shown in FIG. 2.

The extremely stressing requirement for low sidelobe on advanced phased array radar applications requires an innovative approach to sidelobe reduction. A new technique is described which provides 10 dB and better reduction in two-way sidelobes. The design of sidelobe level control for an array nearly always assumes matched polarization. Sidelobe levels are controlled by amplitude weighting resulting from the aperture shape and the element excitation amplitudes and/or by phase adjustments.

Figure 3:
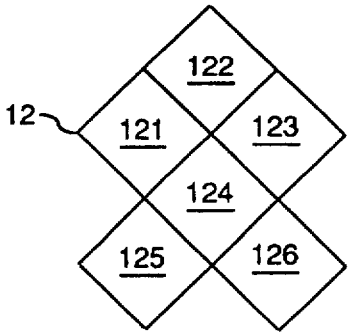
FIG. 3 PRIOR ART
FIG. 3 is a prior art square element planar array system.

FIG. 3 is a prior art square antenna array described in the above-cited Wiener patent. It is divided into four sub-array elements 121–124 with two auxiliary antenna elements 125 and 126. Such systems use all the array elements 121–126 to transmit with uniform polarization and to receive target echo return signals. The transmitted beam is electronically steered by varying the phase of the signals fed to the elements across the face of the array.

Changing the polarization in total for the array affects the mainbeam and sidelobe equally and is, therefore, not desirable from a radar viewpoint since mainbeam detectability will be adversely affected and the radar will not function efficiently. To these authors'knowledge, no attempt has been made to design an array antenna to have changing polarization selectively in the sidelobe direction and not changing in the mainbeam direction.

It is perhaps technically important to observe that for reflector antennas. The sidelobe regions have changing polarization due to the geometry of parabolic reflectors. It has not been analyzed, and is not traditionally discussed, that this changing polarization should be mismatched between transmit and receive. A reflector antenna performance is analyzed from a matched polarization sense, but in actual operation, the sidelobe response would be lower due to this mismatch loss. Therefore, a reflector would operate more effectively than designed, but since this is not detrimental, it is not studied or perhaps not the application for this invention, the application is for an antenna having an array of discrete elements (such as a phased array antenna) and the effect is purposefully created and utilized. The technique for achieving polarization mismatch is not the same as for a reflector since it relies on physical element placement and selection rather than coincidental reflector geometry.

Figure 4:
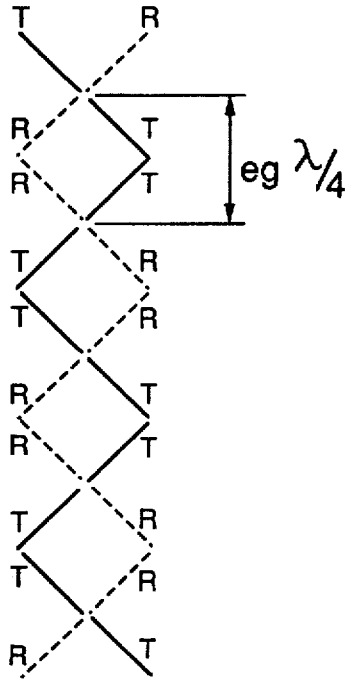
FIGS. 4 and 5 respectively depict and offset a co-located elements line array system which uses the principles of the present invention.
Figure 5:
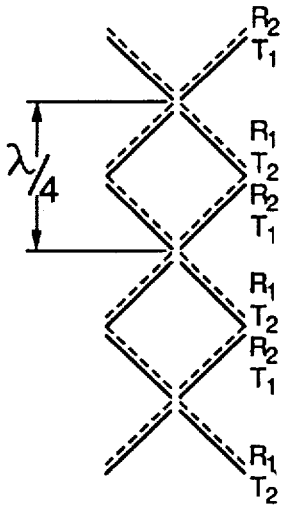

FIGS. 4 and 5 are illustrations of line array models for pairs of offset elements (in FIG. 4) and co-located pairs of elements where a polarization mismatch between transmit and receive is induced by having a pair of orthogonally polarized elements which are NOT co-located and a second pair oriented physically orthogonally and similarly offset to the first pair. One pair is used on transmit, the other on receive. The offset or non-colocation creates a parallax induced phase shift between the orthogonal elements in the pair which varies with aspect angle or with varying angle into the sidelobe region. The net phase shift has a 180° differential between the transmit pair and the receive pair due to the orthogonality of the pairs to each other. The result is a polarization change throughout the sidelobe region that is of orthogonal sense between transmit and receive, yet of parallel but opposite sense in the main beam direction.

The sidelobe reduction benefit occurs when a two-way antenna pattern is considered. That is, each pattern (transmit or receive) has the same character as traditionally analyzed and designed but they differ in polarization. When polarization mismatch is included in the antenna pattern characteristic, the orthogonal sense of polarization shift in the sidelobe results in cancellation of signals between transmit and receive and, therefore, a net polarization loss or sidelobe level reduction in the combined two-way pattern. The opposite sense in the main beam direction results in a net additive effect as desired since the 180° differential is ignored in the phase of the received signal.

Also shown in FIG. 4, polarization mismatch can be induced by having a pair of orthogonally polarized elements which are not co-located. Using orthogonal elements creates two basic vectors for which any polarization can be created by varying the phase between the two elements. Thus, a slant right element and a slant left element can be excited in phase for vertical polarization, 90° out of phase for circular polarization, etc. If the element phase centers are not co-located, the desired polarization will be created only in the main beam direction. Away from the main beam, the offset will create a parallax induced phase shift and a different polarization will exist. Since the parallax phase changes with aspect angle, a different polarization will exist at every point in the sidelobe region. This, in itself, has definite ECM detectability and ECCM sensitivity benefits.

Advantage can be taken of this changing polarization to lower the radar two-way sidelobe response. If on receive, an additional 90° phase delay is added to each basis vector or orthogonal element, the net polarization generated will be the same type but of opposite sense. That is, vertical will be vertical but a 180° delay will have been added. This does not affect radar two way gain since round trip phase is not used. But in the sidelobes, the opposite sense will result in a polarization mismatch loss within the antenna. A perfect mismatch occurs when the phase delay caused by parallax is 90 and the sense reversal is applied on receive. At this aspect angle, a vertical field at boresight will be, say, right circular on transmit but left circular on receive. The two way antenna gain in this direction is a null. The proper choice of element spacing can place the polarization mismatch null anywhere in the sidelobe region that is most beneficial. A specific application would be to reduce ground clutter sidelobes.

FIG. 5 shows the transmit and receive element locations for a proposed configuration. This arrangement has been modeled for a simple linear array to compute polarization mismatch loss and the two way antenna patterns which result. Polarization mismatch loss is the dot product of the two vectors in question, namely, the transmit and the receive. If one assumes the return signal is the same sense on the transmit signal then the polarization mismatch loss is given by $PL=T\times R^*$. This limit bounds the amount of sidelobe reduction achievable in practice for arbitrary scattering targets or clutter.

Figure 6:
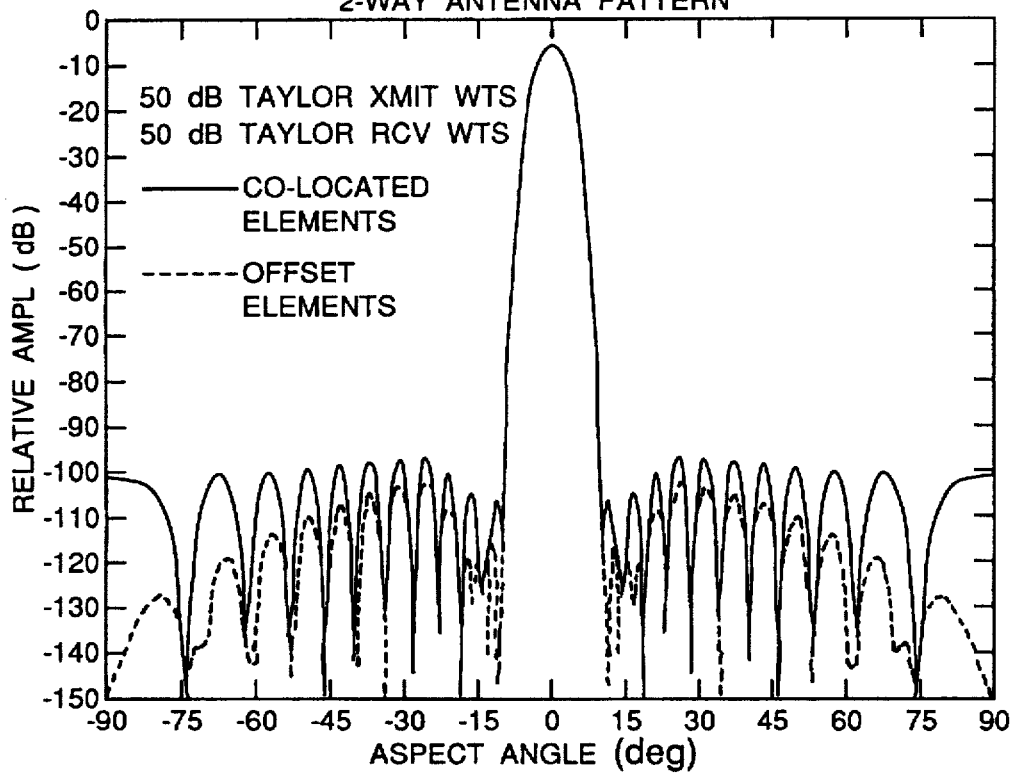
FIG. 6 is a chart of the antenna pattern vs. aspect angle of the arrays of FIGS. 4 and 5.
Figure 7:
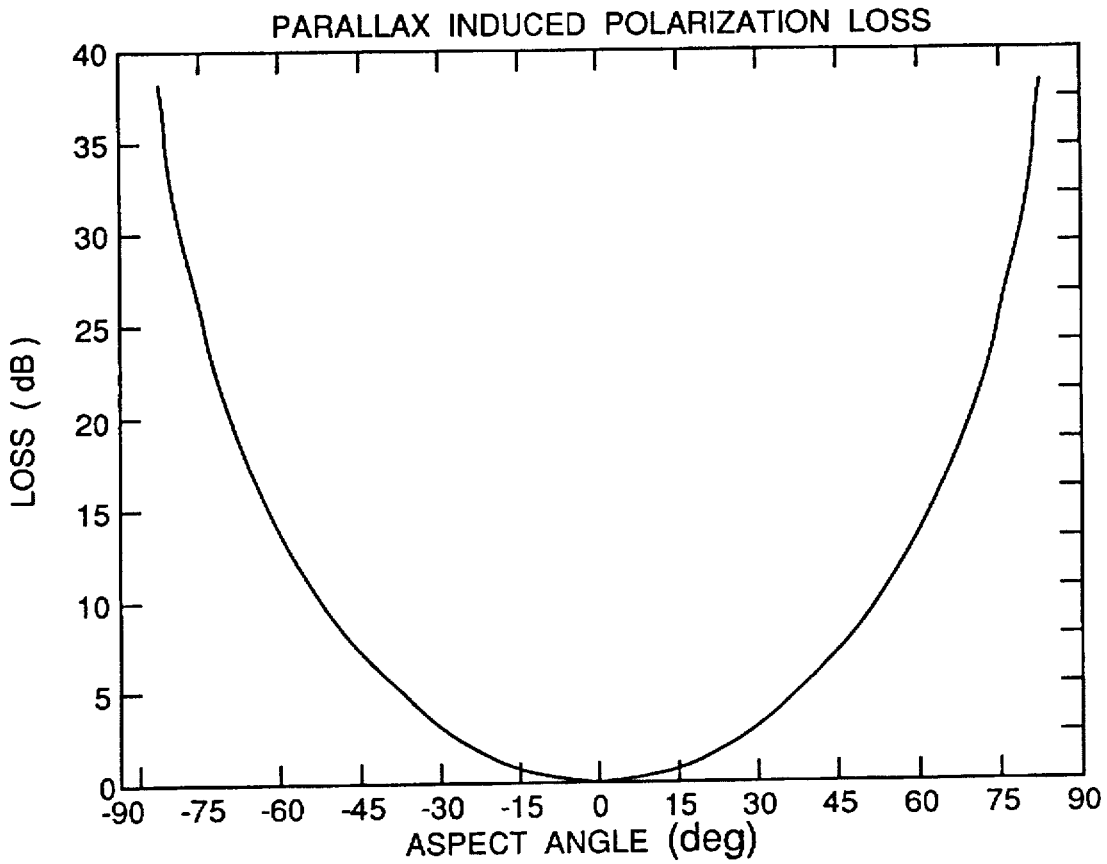
FIG. 7 is a chart of parallax induced polarization loss of the systems of FIGS. 4 and 5.

The antenna pattern for a line array of quarter wavelength spaced elements is plotted in FIG. 6 relative to a polarization matched, co-located transmit and receive element array. FIG. 7 is a plot of the polarization mismatch loss limit, or difference between the two patterns of FIG. 4, for the example line array. The loss is zero at boresight and increases co-sinusoidally to infinity at end fire. Clearly, a significant reduction in achievable sidelobe levels is possible using the unique approach of the present invention.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A process of optimizing sidelobe reduction in an array of pairs of transmitting and receiving antenna elements that emit an antenna pattern at a predetermined wavelength, said antenna pattern containing a main beam and sidelobes, said process comprising the steps of:

identifying pairs of transmitting and receiving antenna elements that contribute chiefly to sidelobe emission to produce sets of identified pairs, adjusting a separation distance between the transmitting and receiving antenna elements of the identified pairs to induce thereby a polarization mismatch in the sidelobes of the antenna pattern and null thereby said sidelobes in which said transmitting antenna elements of said set of identified pairs are offset by one quarter wavelength from their corresponding receiving antenna elements in said adjusting step;

testing the antenna pattern of the array to measure the sidelobes; and repeating the adjusting and testing steps until an optimum performance level is achieved.

2. A process of optimizing sidelobe reduction in an array of pairs of transmitting and receiving antenna elements that emit an antenna pattern at a predetermined wavelength said antenna pattern containing a main beam and sidelobes said process comprising the steps of:

identifying pairs of transmitting and receiving antenna elements that contribute chiefly to sidelobe emission to produce sets of identified pairs;

adjusting a separation distance between the transmitting and receiving antenna elements of the identified pairs to induce thereby a polarization mismatch in the sidelobes of the antenna pattern and null thereby said sidelobes, wherein said adjustment step includes an adjustment in an amplitude and phase of signals sent to the transmitting antenna elements of said sets of identified pairs and in which said transmitting antenna elements of said set of identified pairs are offset by one quarter wavelength from their corresponding receiving antenna elements in said adjusting step, testing the antenna pattern of the array to measure the sidelobes: and repeating the adjusting and testing steps until an optimum performance level is achieved.

3. A process, as defined in claim 1, in which said array, has first and second sets of transmitting and receiving antenna elements such that each of said first transmitter antenna elements is co-located with one of said second set of receiving antenna elements, and wherein each of said first receiving antenna elements is co-located with one of said second set of transmitting antenna elements, and wherein said adjusting step separates each of the transmitting antenna elements one half a wavelength from their corresponding receiving antenna elements.

4. A process, as defined in claim 2, in which said array has first and second sets of transmitting and receiving antenna elements such that each of said first transmitting antenna elements is co-located with one of said second set of receiving antenna elements, and wherein each of said first receiving antenna elements is co-located with one of said second set of transmitting antenna elements, and wherein said adjusting step separates each of the transmitting antenna elements one half a wavelength from their corresponding receiving antenna elements.

* * * * *